US006938860B2

(12) United States Patent
Singleton

(10) Patent No.: US 6,938,860 B2
(45) Date of Patent: Sep. 6, 2005

(54) ADJUSTABLE COLLAPSIBLE REFUSE FUNNEL

(76) Inventor: Wilbert L. Singleton, 402 Singleton Trace, Diana, TX (US) 75640-9784

( * ) Notice: Subject to any disclaimer, the term of this patent is extended or adjusted under 35 U.S.C. 154(b) by 0 days.

(21) Appl. No.: 10/688,256

(22) Filed: Oct. 16, 2003

(65) Prior Publication Data

US 2004/0195468 A1 Oct. 7, 2004

Related U.S. Application Data

(60) Provisional application No. 60/459,308, filed on Apr. 1, 2003.

(51) Int. Cl.[7] ..... B65B 67/04
(52) U.S. Cl. ..... 248/99; 141/390
(58) Field of Search ..... 248/99–101, 95, 248/98; 294/1.1; 15/257.1; 141/103, 314, 316, 390

(56) References Cited

U.S. PATENT DOCUMENTS 2,006,036 A * 6/1935 Ware ..... 493/149
2,100,888 A * 11/1937 Vine ..... 141/337
2,105,844 A * 1/1938 Reagan ..... 229/400
2,129,498 A * 9/1938 Krein et al. ..... 229/400
2,605,582 A * 8/1952 Allen ..... 43/100
2,939,614 A * 6/1960 Hill ..... 222/190
3,181,742 A * 5/1965 Kebert ..... 222/527
4,009,805 A * 3/1977 Klygis et al. ..... 222/530
4,312,531 A * 1/1982 Cross ..... 294/55
4,530,533 A * 7/1985 Dieter ..... 294/1.1
4,749,011 A * 6/1988 Rylander ..... 141/316
4,896,707 A * 1/1990 Cowles ..... 141/337
5,056,679 A * 10/1991 Lonczak ..... 141/390
5,121,779 A * 6/1992 Green ..... 141/337
5,716,033 A * 2/1998 Gibson ..... 248/95

* cited by examiner

*Primary Examiner*—Korie Chan
(74) *Attorney, Agent, or Firm*—Ronald B. Sefrna

(57) ABSTRACT

An adjustable collapsible refuse funnel has a generally planar body formed of a relatively rigid but flexible and shape-retentive material, the body having a front edge, a rear edge, and opposing side edges, the body being deformable into a funnel configuration by bringing the rear corner portions of the body into overlapping relation and releasably connecting the overlapping rear corner portions to form a throat, leaving the front portion of the body adjacent to the front edge in generally planar configuration. Attachment means for releasably attaching a leaf bag or other refuse container are provided on the body. Creases are preferably formed in the body to facilitate forming the rear portion into a throat while maintaining the generally planar configuration of the front portion.

20 Claims, 7 Drawing Sheets

ADJUSTABLE COLLAPSIBLE REFUSE FUNNEL

RELATED APPLICATION INFORMATION

This application claims the benefits of U.S. Provisional Patent Application Ser. No. 60/459,308, filed Apr. 1, 2003, titled "Adjustable Collapsible Refuse Funnel".

FIELD OF THE INVENTION

The present invention generally relates to refuse receptacle devices, and in its preferred embodiments more specifically relates to a collapsible funnel device for holding leaf/refuse bags and facilitating the raking or sweeping of leaves and other refuse into a bag.

BACKGROUND OF THE INVENTION

Leaf or trash bags are well known and commonly used for the collection and disposal of leaves and other types of refuse from lawns and other generally flat areas from which it is raked or swept and placed in bags. In order to reduce their cost and bulk, such leaf or trash bags are typically made of thin plastic material with sufficient tensile strength to hold low density materials such as leaves or paper, but with no rigidity or "body" whatsoever. As a result, the bags will not stand alone when empty, and must be supported in some manner for filling. Although bags can be held open by hand, this approach is very inefficient and can be very frustrating when a single person is attempting to fill bags. It is also often desirable to be able to rake or sweep leaves and other refuse into a bag with the bag lying flat, and it is almost impossible for a single person to hold a bag open by hand while raking or sweeping refuse into it.

Various approaches have been attempted in an effort to address the problem of supporting a bag in an open position for filling, with varying degrees of success. Placing a bag inside an existing trash can or box will provide support for the bag and allow it to be filled from the top, but this approach does not readily accommodate raking or sweeping refuse into the bag. Further, a filled bag can be difficult to remove from a trash can.

A number of devices have been devised for the specific purpose of holding or supporting a leaf or trash bag while it is filled, but all such devices known in the prior art have disadvantages or drawbacks. One such device comprises a rigid structure with a pair of centrally pivoting legs, designed to fold flat for storage and to support a bag suspended between the legs when open. The only means of adjustment for bags of differing sizes is the degree to which the legs are pivoted open, which can result in excessive force against the top of the bag and tearing of the bag. This device is useable only in an upright position, and does not securely hold the bag in place to prevent slipping. In addition, a filled bag can be difficult to remove from between the legs of the device without tearing the bag.

Another device is formed as a flexible, shape retentive plastic sheet that can be rolled into a cylinder and placed inside a bag. When the rolled sheet is released it partially unrolls until constrained by the bag, so that the force of the sheet against the inside of the bag holds it in an open, generally cylindrical form. When the bag is filled, the sheet is slipped from the open end of the bag. Although a bag opened with this device can be placed on its side for filling, only a small area is in contact with the ground because of the cylindrical form, and raking or sweeping material into the bag is difficult. Use of this device can be cumbersome for a single person because it is necessary to hold the rolled sheet to prevent it from unrolling while, at the same time, holding the bag open and inserting the rolled sheet into the bag. This device will accommodate different sized bags, although the force holding and supporting the bag will vary and the bag may slip along the sheet and become disengaged during handling and filling.

Yet another device includes a body with a funnel-like opening with a large throat to which a bag can be attached. The body is supported by legs so that the bag can be hung from the body, secured by clips, between the legs or with the legs in the interior of the bag. The bag is then filled from the top. In some variations the bag and support structure may be placed on the ground, either with or without the legs, so that leaves, etc. can be raked or swept into the bag, but the design of the body does not facilitate use in a horizontal orientation and it can be difficult to push leaves, etc. through the opening to fully fill the bag. These structures are of rigid construction with no provision for adjustment to accommodate bags of different sizes. In addition, they are relatively large and bulky, and require a significant amount of storage space.

SUMMARY OF THE INVENTION

The present invention provides a device that is particularly suited and specifically designed to securely hold and support an open leaf or trash bag in a horizontal orientation on the ground, floor, or other generally flat surface, and to provide an expansive opening to guide leaves, etc. into the bag, to greatly facilitate raking or sweeping of leaves, etc. into the bag by a single person. An empty bag may be quickly and easily attached to the device, and a filled bag may be easily removed from the device without spilling the contents of the bag.

The body device of the invention is formed as a flat sheet, for ease of transportation and storage prior to use, which can be easily and quickly formed into a three dimensional configuration for use and then returned to a flattened configuration for storage between uses. The rear corner portions of the body may be easily rolled toward each other and overlapped to form a generally cylindrical throat, or passageway, for leaves and other refuse. Releasable connection means, preferably in the form or interlocking tabs and slots disposed in the respective rear corner portions of the body, allow the body to be maintained in the overlapping configuration. The degree of overlap, and thus the size of the throat, is preferably adjustable, allowing the device to readily accommodate bags of differing sizes. A variety of alternative connection means may be used.

In the preferred embodiment, a pair of angled creases are formed in the front portion of the body, each extending from a point near one of the front corners of the body at an angle to the front edge toward the rear edge of the body. When the rear corner portions of the body are overlapped the front portion of the body bends at the creases so that the front portion of the body between the creases and inward from the front edge remains generally planar. The planar, or flat, configuration facilitates entry of leaves and other refuse onto the body and into a container. In the preferred embodiment a front crease is also formed in the body parallel to and slightly inward from the front edge, allowing the front edge portion of the body to be bent downward to further assist in maintaining the flat configuration of the front portion of the body and to form a lip to further facilitate entry of refuse over the front edge. Additional creases may also be formed along the side edges and the rear edge of the body for additional stiffening effect.

Attachment means in the form of tabs or ears are provided in the preferred embodiment of the body, for attachment of the drawstring or upper edge of a leaf bag to the body. The attachment tabs are disposed so that the throat of the device is received partially inside the bag or other container. A variety of alternative attachment means may be used.

The structure and features of preferred and alternative embodiments of the device of the invention will be described in detail with reference to the accompanying drawing figures.

DESCRIPTION OF THE INVENTION

Figure 2:
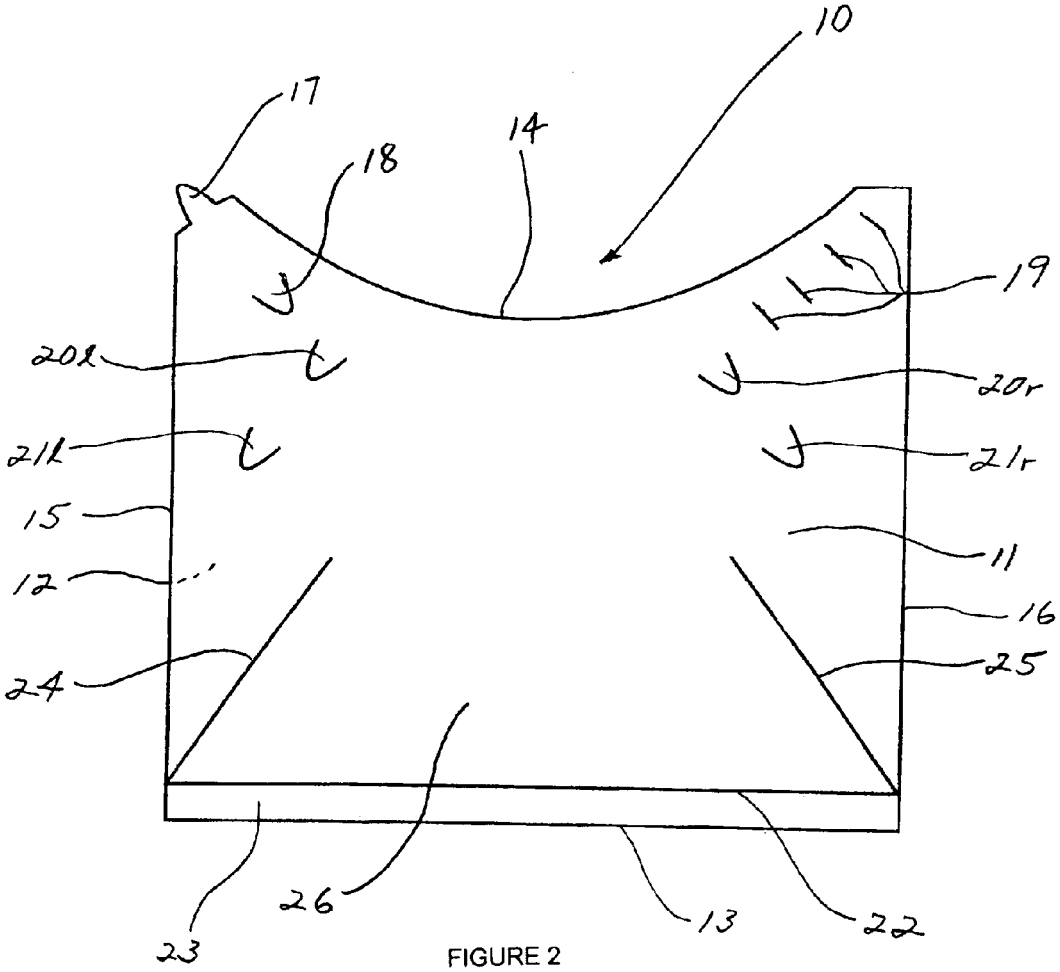
FIG. 2 is a top plan view of the preferred embodiment of the device of the invention, in flattened configuration.

Referring now to the drawing figures, with initial emphasis on FIG. 2, the preferred embodiment of the device of the invention is formed as a generally rectangular thin planar body 10, of a relatively stiff, but flexible and generally shape retentive material. In the preferred embodiment the material of construction of the body is an inexpensive and readily available material such as plastic, heavy pasteboard or cardboard. However it is to be understood that the scope of the invention is not dependent upon any particular material, and that a variety of materials, such as sheet metal, may be used so long as the material has suitable characteristics for the functioning of the device of the invention.

Body 10 is initially formed as a generally rectangular flat sheet, as shown in FIG. 2, with an upper face 11, a lower face 12, a front edge 13, a rear edge 14, and side edges 15 and 16. In the preferred embodiment the front and side edges are straight, and rear edge 14 is curved through the majority of its length. The curvature of the rear edge of the body is symmetrical, with the shallow curve or arc beginning at a point along the rear edge slightly inward from the corner formed by the rear edge and side edge 16, and extending to a point slightly inward from the opposite side edge 15. A tab 17 is formed at the intersection of rear edge 14 and side edge 15, so that tab 17 extends outwardly from the main portion of body 10. A second tab, 18, is formed inward toward the interior of body 10 from tab 17 by making a, e.g., parabolic cut in the body, freeing the portion of the body comprising tab 18 so that it can be deformed outwardly from the plane of the body with its outer end extending toward the interior of the body, opposite tab 17. A line bisecting tabs 17 and 18 is oriented at an angle relative to side edge 15 of the body of the device.

A series of slots 19 is formed in body 10 across and in generally perpendicular relation to a line extending from the intersection of rear edge 14 and side edge 16 toward the interior of the body at generally the same angle relative to side edge 16 as the line bisecting the tabs relative to side edge 15. The length of each of slots 19 is equal to or slightly larger than the width of the bases of tabs 17 and 18, so that tabs 17 and 18 can be inserted through selected slots 19 when the device is prepared for use. In the preferred embodiment shown in FIG. 2, the number of slots is four, but the number of slots could be changed if desired within the scope of the invention. The slots are symmetrically spaced, with the distance between adjacent slots preferably being half the distance between the bases of tabs 17 and 18.

At least one pair of bag retaining tabs or ears **20*l* (left) and 20*r* (right) are disposed in body 10 in mirrored relation across a bisector line extending between the front and rear edges of the body and equidistant from the side edges. In the preferred embodiment a second pair of ears 21*l* and 21*r* are provided. The ears are formed by making a, e.g., parabolic cut in the body in the same manner used to form tab 18, so that the ears can be pushed outwardly from the plane of the body at an angle to the body, like tab 18. In the preferred embodiment ears 20*l* and 21*l*, and ears 20*r* and 21*r* are respectively oriented on a line generally perpendicular to the line bisecting tabs 17 and 18, and on a line generally perpendicular to the line of slots 19**, and extending toward the respective sides of the body.

It is preferred that pre-formed creases be provided in the front portion of the body of the device to facilitate forming the body into the optimal configuration for receiving leaves or other refuse and funneling them into a collection bag during use of the device. In the preferred embodiment a front crease 22 extends between side edges 15 and 16 parallel to front edge 13 a short distance inward from the front edge. Crease 22 allows a narrow strip along the front edge of the body to be bent downward to form a stiffening lip 23 that also serves as an entry ramp for leaves, etc. over the front edge of the device. A pair of angled creases 24 and 25 extend in mirrored relation from the intersection of crease 22 with side edge 15 and with side edge 16, respectively, toward the interior of body 10. Each of creases 24 and 25 preferably extend at an angle of less than forty-five degrees relative to the respective side edge 15 and 16, through a length less than half the length of side edges 15 and 16.

Figure 1:
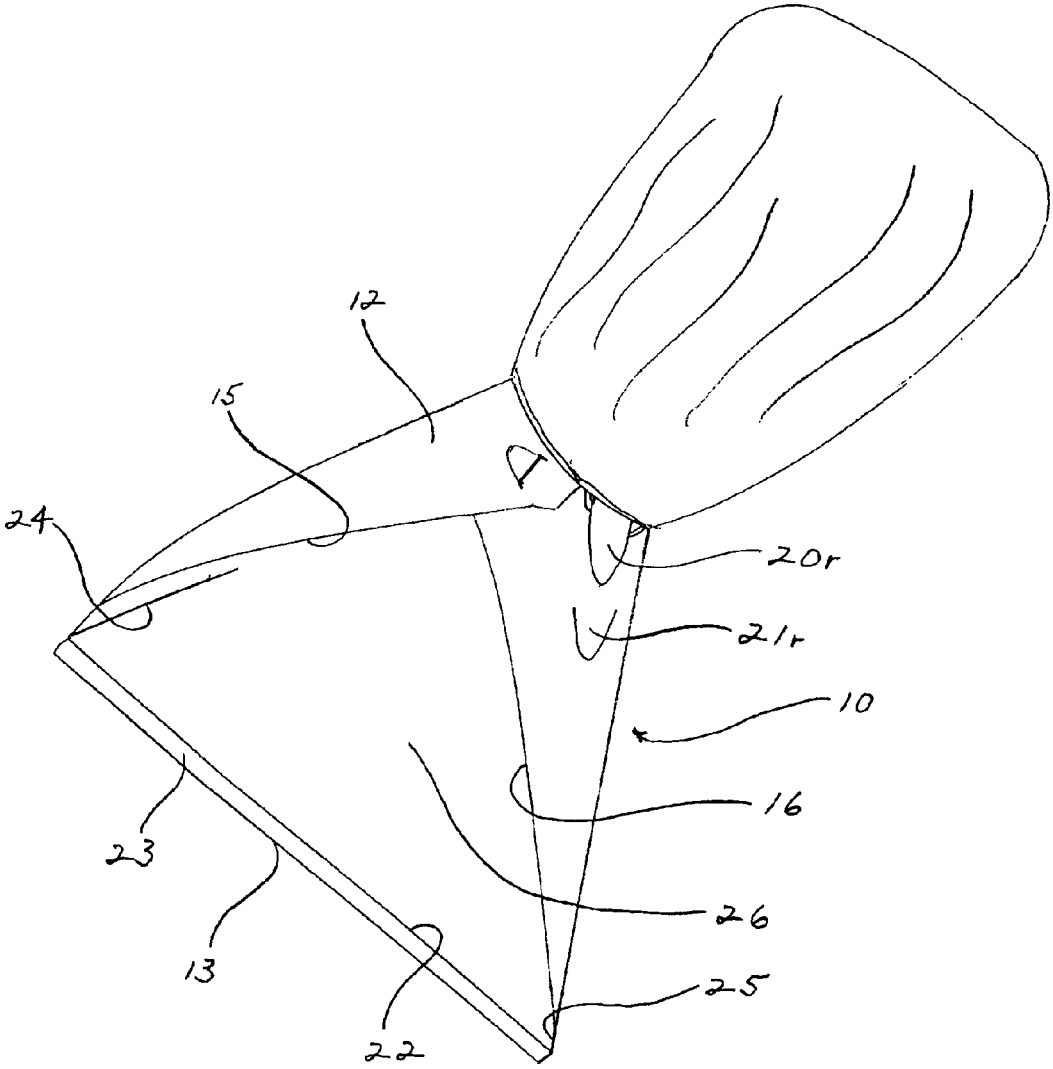
FIG. 1 is top perspective view of the preferred embodiment of the device of the invention, assembled for use, with a bag attached.
Figure 3:
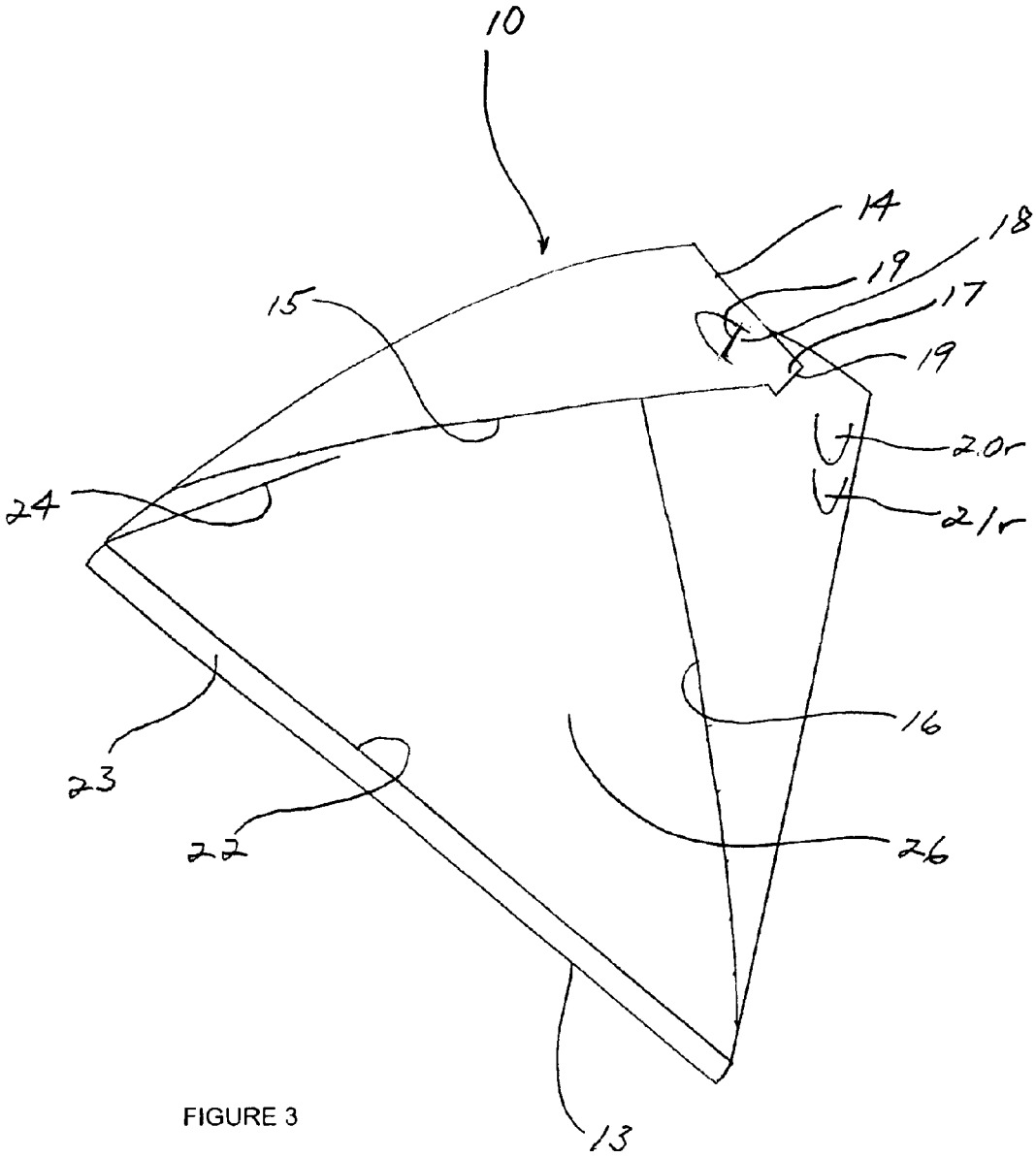
FIG. 3 is a top perspective view of the preferred embodiment of the device of the invention, assembled for use as in FIG. 1, without a bag.
Figure 4:
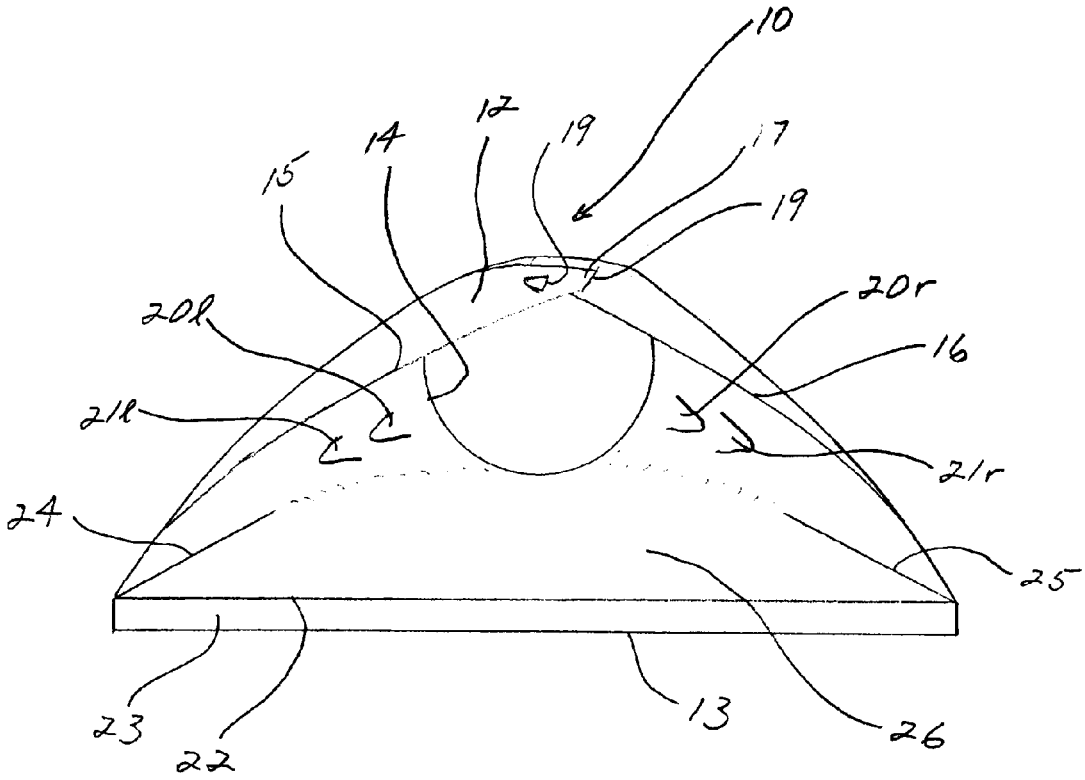
FIG. 4 is a front elevation view of the preferred embodiment of the device of the invention, assembled for use, without a bag.

To form the device into the configuration shown in FIGS. 3 and 4 and prepare it for attachment of a bag and use in the collection of refuse, the rear corner portions of the body are lifted and brought toward each other so as to draw the rear portion of the body into a curvature and toward a generally cylindrical configuration. The left rear corner portion of the body is brought over the right rear corner portion of the body, with the upper face of the left rear portion (which includes tabs 17 and 18) adjacent to the lower face of the right rear portion (which includes slots 19). Tab 18 is deflected from the plane of the body and inserted into a selected one of slots 19, and tab 17 is inserted into the second adjacent slot toward the interior of the body, securely but releaseably connecting the rear corner portions of the body together. With the stiffening lip 23 folded downward, the front edge portion of the body remains flat as the rear portion is curved. The body folds along creases 24 and 25 so that the front portion of the body between those creases, designated by reference numeral 26, remains substantially flat and planar. The portions of the body between each of creases 24 and 25 and the respective adjacent side edge curve upward and inward from the adjacent crease. With tabs 17 and 18 received in the selected slots 19, and with the stiffening at the front edge of the body provided by lip 23, the device is very stable in its assembled configuration and will retain that configuration until the tabs are removed from the slots. Therefore, the device may be easily carried from place to place in the assembled configuration, and will easily withstand the forces and stresses of use without collapsing. To complete the preparation for use, a bag is placed over the rear portion or throat of the device, and ears 20 or 21 are used to secure the bag in place. It is preferred that the ears are disposed on the body so that they are in generally opposed relation on either side of the assembled device. If a collection bag with drawstring closures is used, as shown in FIG. 1, the drawstrings can be placed over the selected ears to secure the bag. If a bag without drawstrings is used, the top (open) edges of the bag can be gathered and folded over the ears to secure the bag.

As configured for use, the device of the invention provides a wide, flat entry area for leaves, etc. at the front of the device, and a smooth transition into a generally cylindrical throat through which leaves and other refuse may be easily passed to the interior of a collection bag attached to the device. The width of the front edge of the device substantially eliminates the problem of raking or sweeping leaves, etc. past the opening into a collection bag and along the sides of the bag. As can be seen in FIG. 3, the upper portion of the device above the flat portion is open, providing an unrestricted entry area for leaves, etc., allowing leaves to be directed into the throat from an upwardly inclined angle, which is particularly useful when filling bags from a pile of leaves. The provision of a plurality of slots 19 allows the dimension of the throat of the assembled device to be adjusted to accommodate bags of different sizes, and the provision of a plurality of ears for bag attachment also accommodates a variety of sizes and types of bags. Because the device is stable in its assembled configuration, and because bags are securely attached to it, the device and attached bag may be lifted from the ground to assist in settling leaves, etc. in the bag, and then returned to a horizontal position to receive more leaves, etc. through the device. It can be seen, therefore, that the device of the invention facilitates the collection and bagging of leaves and other refuse materials to a degree unavailable from devices known in the prior art.

Figure 5:
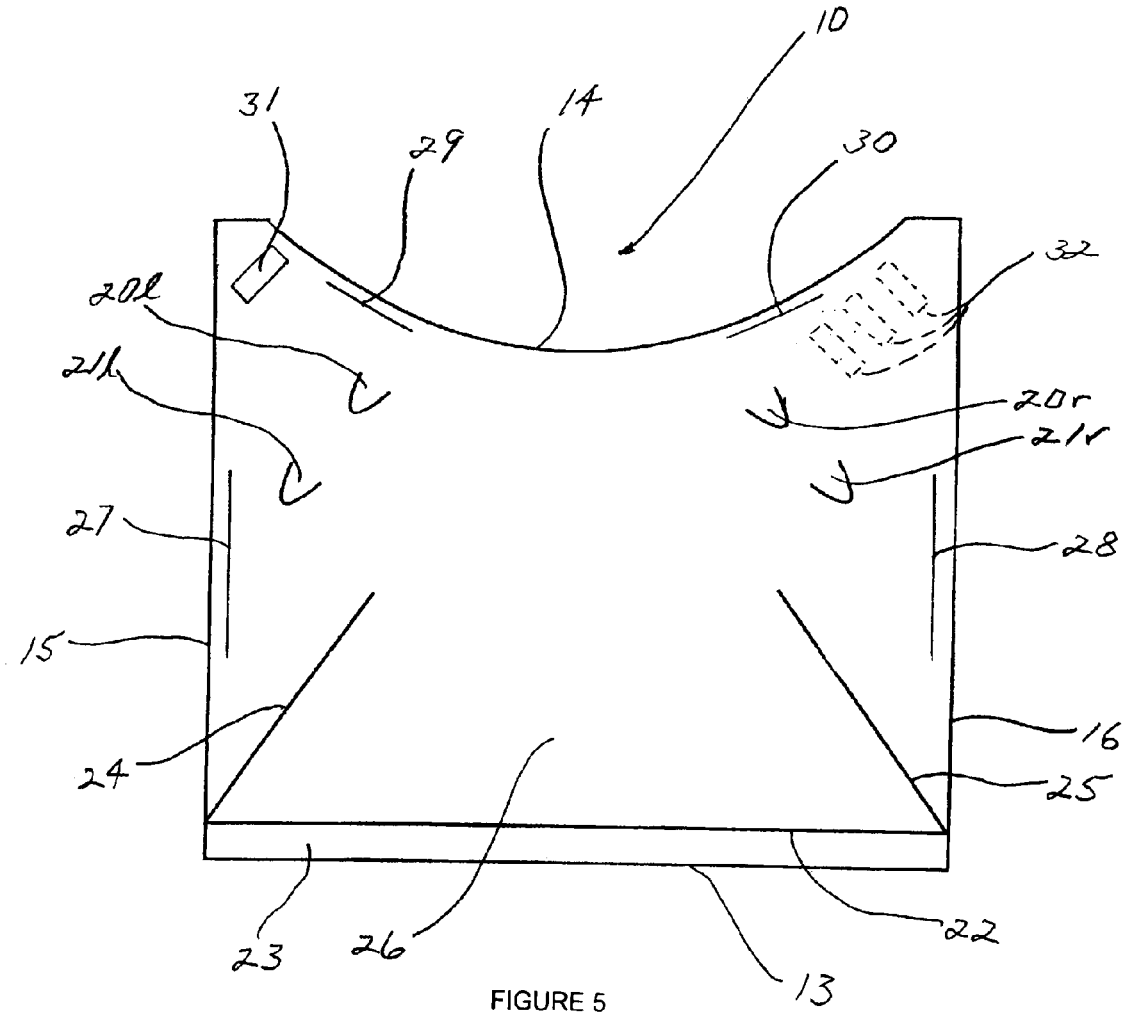
FIG. 5 is a top plan view of an alternative embodiment of the device of the invention, in a flattened configuration.

Even greater stability can be imparted to the body of the device of the invention by forming either or both of side creases 27 and 28, and/or rear creases 29 and 30 in the body, as shown in FIG. 5. The side creases are particularly useful when body 10 is constructed of a lightweight material such as pasteboard, but may be used in conjunction with any material of construction. As shown in FIG. 5, side creases 27 and 28 extend parallel to side edges 15 and 16, respectively, a short distance inward from those side edges, and through a portion of the length of the side edges. The body of the device is bendable at the side creases so that a strip of the body may be bent away from the plane of the remainder of the body at each crease to resist any tendency of the edges of the body to deform in the area of the creases. Similarly, rear creases 29 and 30 are symmetrically disposed adjacent to rear edge 14 on either side of a centerline of the body extending between the front edge and the rear edge equidistant from the two side edges. A thin strip of the rear edge may be bent outwardly in relation to the interior of the throat, to stiffen the rear edge and resist any tendency of the throat portion of the device to close during use.

When a session of use of the device has been completed, the device can be easily flattened again for storage. Without a bag attached to the device, tabs 17 and 18 are simply removed from slots 19, releasing the rear corners of the body and allowing it to return to a planar configuration. The flattened device may then be stored flat against a wall, requiring almost no storage space. Alternatively, if desired, the body could be rolled into a tube and secured with, e.g., rubber bands or string, and stored in that configuration. Depending upon the material selected for construction of the device, a single device can be used through a period of many years, could be used for one season and then discarded, or could be used once and discarded; and it can be seen that the present invention provides a previously unprecedented level of flexibility in that context as well.

Figure 6:
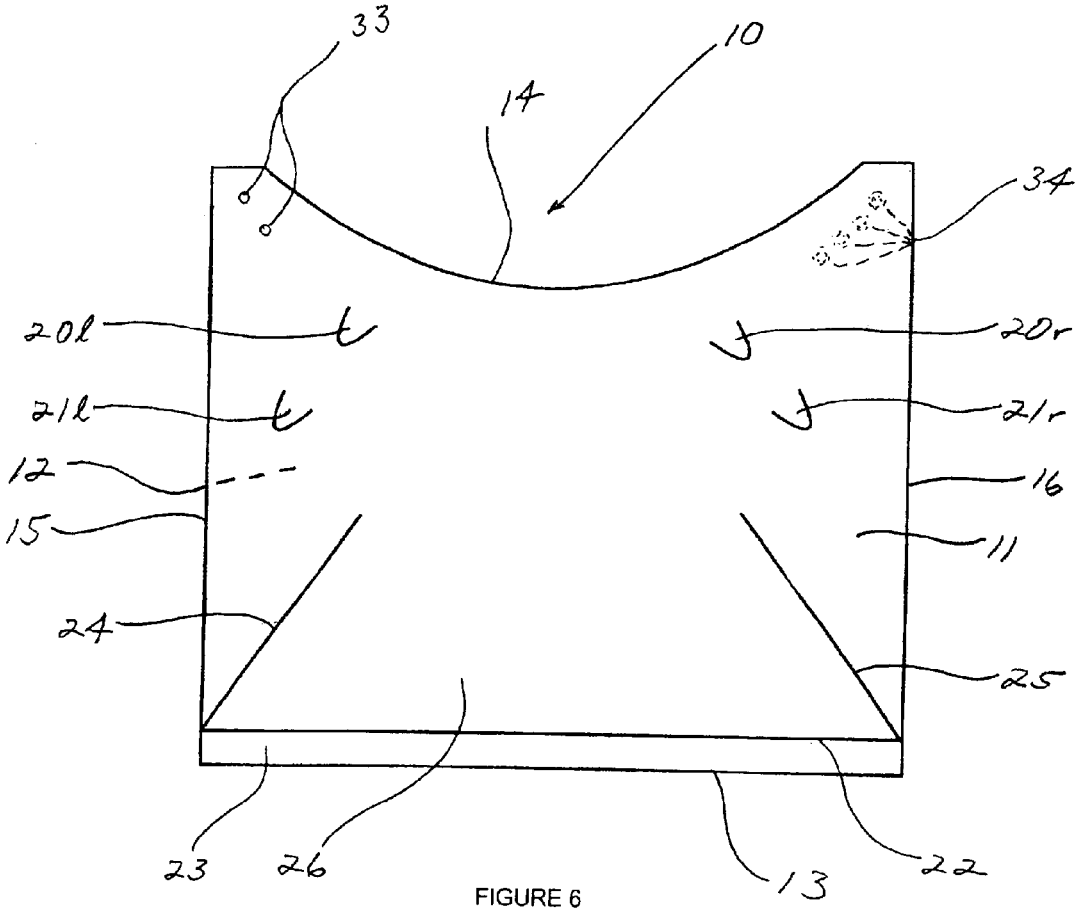
FIG. 6 is a top plan view of a second alternative embodiment of the device of the invention, in a flattened configuration.

Although the foregoing description of the invention has emphasized the preferred embodiment of the invention, it should be understood that a variety of alternative embodiments and variations in the structure of the device may be employed within the scope of the invention. Non-limiting examples of such alternative approaches are illustrated in FIGS. 5 and 6. In FIG. 5 tabs 17 and 18 are replaced by a strip 31 of one part of an interlocking two part hook and loop fastener material, such as Velcro®, and slots 19 are replaced by a plurality of strips 32 of the second part of that material (shown in phantom). It should be understood in the context of this alternative approach that a plurality of strips 31 may be used, for more secure connection. Similarly, a single strip 32 may be used with a single strip 31, although that design would eliminate the adjustability of the device.

In a second alternative embodiment of the connection means, two part releasable snap structures may be used, as shown in FIG. 6. In this alternative approach, at least one first part 33 of the snap structure is connected to one face of the body in the rear corner portion thereof, and at least one second part 34 of the snap structure is connected to the opposite face of the other rear corner portion of the body, so that first and second parts are brought into mating relation when the body is configured for use.

It will also be understood by those of reasonable skill in the art that alternative means for attaching a bag or other refuse container to the device of the invention may be employed within the scope of the invention as illustratively described herein.

Figure 7:
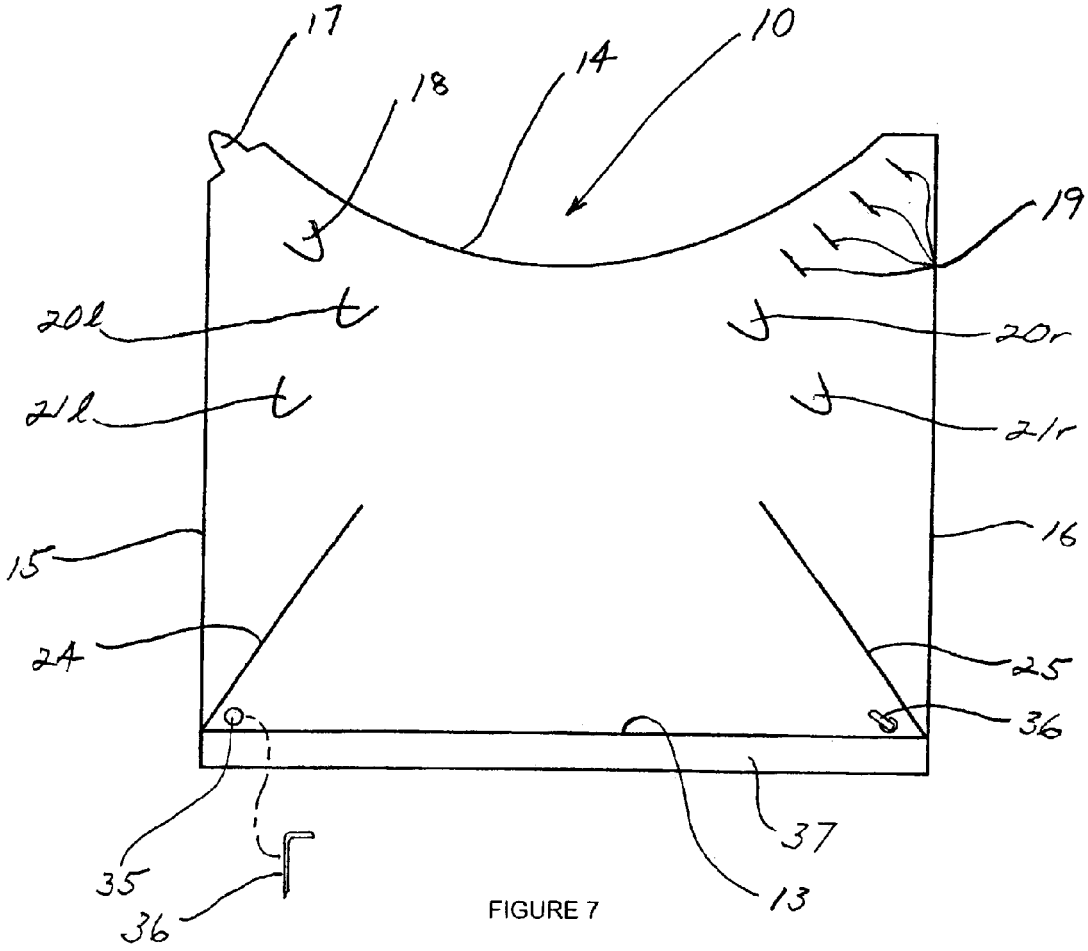
FIG. 7 is a top plan view of an alternative embodiment of the device of the invention, illustrating optional features.

Additional features may also be provided in further alternative embodiments of the device, if desired. For example, although lip 23 tends to engage the surface on which the device is placed and hold it in position, if it is desired to assure that the device is firmly maintained in a fixed position on the ground, apertures 35 may be provided near the front edge of the body, and pins 36 inserted through the apertures and into the ground to securely hold the device in place, as illustrated in FIG. 7. As also shown in FIG. 7, a stiffening bar 37, of e.g., metal or heavy plastic, may be connected, either removably or permanently, to the front edge 13 of the body, if desired, to assure that the front edge remains straight and portion 26 of the body remains flat through repeated uses of the device. If such as stiffening bar is provided, crease 22 may be omitted, since the stiffening bar performs much of the same function as lip 23 of the preferred embodiment.

The description of the preferred embodiment, and the discussion of some alternative embodiments and variations in the structure of the device, are intended to be illustrative and not for purposes of limitation. It is to be understood that further embodiments and variations can be devised, within the scope of the invention as illustratively shown and described. It is intended that all such alternatives and variations are encompassed within the scope of the following claims.

What is claimed is:

1. A collapsible refuse funnel, comprising a generally rectangular planar body having a front edge, a rear edge, a first side edge, a second side edge, and a front crease formed in said body, said front crease extending between said first side edge and said second side edge generally parallel to said front edge, disposed in said body a short distance inwardly from said front edge, said body being bendable at said front crease such that a front portion of said body between said front edge and said front crease may be bent downward at said front crease, said body formable into a funnel configuration by bringing first and second rear corner portions of said body adjacent to the intersections of said first and second side edges, respectively, with said rear edge into overlapping relation with each other without overlapping the first and second front corner portions of said body adjacent to the intersections of said first and second edges, respectively, with said front edge, with said front portion of said body bent downward at said front crease to form a lip, stiffening said front portion of said body such that said front edge and the portions of said body immediately adjacent to said front crease remain substantially flat; and connection means for connecting said rear corner portions of said body in said overlapping relation.

2. The collapsible refuse funnel of claim 1, wherein said rear edge of said body is curved through the majority of its length in a shallow arc extending from a point near the intersection of said first side edge with said rear edge to a point near the intersection of said second side edge with said rear edge.

3. The collapsible refuse funnel of claim 1, further comprising attachment means for releasably attaching a refuse container to said body with said body in said funnel configuration.

4. The collapsible refuse funnel of claim 1, wherein said connection means comprises a first tab formed at a first one of said rear corner portions of said body and extending outwardly from said body generally in said plane thereof, and a second tab formed inwardly on said body from said first tab; and a plurality of slots formed in said body inwardly on said body from the second one of said rear corner portions of said body, said tabs and said slots being disposed and configured so that said tabs and said slots are aligned when said body is formed into said funnel configuration such that each of said tabs may be inserted into a separate one of said slots to maintain said rear corner portions of said body in said overlapping relation.

5. The collapsible refuse funnel of claim 4, wherein the number of said slots is at least four, such that the degree of overlap of said rear corner portions of said body may be adjusted by selecting different ones of said slots for insertion of said tabs.

6. The collapsible refuse funnel of claim 1, wherein said body has an inner face and an outer face, and wherein said connection means comprises at least one first sheet of a first part of a two part releasably interlocking hook and loop connection material disposed in said first rear corner portion of said body and interconnected to one of said faces of said body, and at least one second sheet of a second part of said two part releasably interlocking hook and loop connection material disposed in said second rear corner of said body and interconnected to the opposite one of the faces of said body, said first and second sheets being disposed and configured such that said sheets are brought into overlying alignment when said body is formed into said funnel configuration for the formation of a releasable interlocking connection between said sheets.

7. The collapsible refuse funnel of claim 1, wherein said body has an inner face and an outer face, and wherein said connection means comprises at least one of a first part of a two part releasably interlocking snap fastener disposed in said first rear corner portion of said body and interconnected to one of said faces of said body, and at least one of a second part of said two part releasably interlocking snap fastener disposed in said second rear corner of said body and interconnected to the opposite one of the faces of said body, said first and second parts being disposed and configured such that said parts are brought into overlying alignment when said body is formed into said funnel configuration for the formation of a releasable interlocking connection between said parts.

8. The collapsible refuse funnel of claim 3, wherein said attachment means comprises a plurality of attachment tabs formed in said body and disposed in opposing paired relation on either side of a centerline of said body extending from said front edge to said rear edge equidistant from said side edges.

9. The collapsible refuse funnel of claim 1, wherein said body further includes a first angled crease formed in said body and a second angled crease formed in said body, said first angled crease extending from a point on said first side edge of said body adjacent to said front edge of said body toward said rear edge of said body at an angle relative to said first edge for a distance less than the length of said first side edge, and said second angled crease extending from a point of said second side edge of said body adjacent to said front edge of said body toward the rear edge of said body at an angle relative to said second edge for a distance less than the length of said second side edge, said body being bendable at said first and second angled creases such that the front portion of said body between said angled creases inward from said front edge will remain generally planar when said body is formed into said funnel configuration.

10. The collapsible refuse funnel of claim 9, wherein said angle between said first angled crease and said first side edge is between about thirty degrees and about forty-five degrees, wherein said angle between said second angled crease and said second side edge is approximately equal to said angle between said first angled crease and said first side edge, wherein the length of said first angled crease is less than about half the length of said first side edge, and wherein the length of said second angled crease is approximately equal to the length of said first angled crease.

11. The collapsible refuse funnel of claim 1, wherein said body further includes a first side crease formed in said body and a second side crease formed in said body, said first side crease extending generally parallel to and disposed a short distance inward from said first side edge, and said second side crease extending generally parallel to and disposed a short distance inward from said second side edge, said body being bendable at said first side crease and at said second side crease such that side portions of said body between said first side edge and said first side crease, and between said second side edge and said second side crease may be bent away from the plane of said body to stiffen and stabilize said side edges.

12. The collapsible refuse funnel of claim 1, wherein said body further includes a first rear crease formed in said body and a second rear crease formed in said body, said first rear crease extending generally parallel to said rear edge and disposed a short distance inward from said rear edge on one side of a centerline of said body extending between said front edge and said rear edge equidistant between said side edges, and said second rear crease extending generally parallel to said rear edge and disposed a short distance inward from said rear edge on the other side of said centerline, said body being bendable at said first rear crease and at said second rear crease such that rear portions of said body between said rear edge of said body and said first rear crease, and between said rear edge of said body and said second rear crease can be bent away from the plane of said body to stiffen and stabilize portions of said rear edge.

13. A collapsible refuse funnel, comprising a body formed of a relatively rigid deformable and shape retentive material, said body having a generally planar front portion with a front edge having a first end and a second end, and said body having a curved throat portion interconnected to said front portion, said throat portion having a wall with a rear edge, a first side edge, and a second side edge, said first side edge extending from said first end of said front edge to said rear edge to form a first rear corner, and said second side edge extending from said second end of said front edge to said rear edge to form a second rear corner, said first rear corner and a first corner portion of said wall adjacent thereto being disposed in overlapping relation with said second rear corner and a second corner portion of said wall adjacent thereto, thereby forming a generally cylindrical refuse passageway adjacent to said rear edge;

releasable connection means for releasably connecting said overlapping first and second corner portions of said wall to maintain said refuse passageway, and to allow said body to be flattened into a general planar configuration upon release of said releasable connection means; and attachment means for removably attaching a refuse container to said body to receive refuse through said refuse passageway.

14. The collapsible refuse funnel of claim 13, wherein said front portion of said body and said throat portion of said body are integrally formed as a single piece.

15. The collapsible refuse funnel of claim 13, wherein said releasable connection means comprises a first tab formed at said first corner portion of said body and extending outwardly from said first corner, and a second tab formed inwardly of said first corner in said first corner portion and extending in the opposite direction from said first tab; and a plurality of slots formed in said second corner portion of said body inward of said second corner, said tabs and said slots being disposed and configured so that said tabs and said slots are aligned when said first and second corner portions are in overlapping relation such that each of said tabs may be inserted into a separate one of said slots to maintain said corner portions of said body in said overlapping relation.

16. The collapsible refuse funnel of claim 13, wherein said body further includes a first angled crease formed in said body and a second angled crease formed in said body, said first angled crease extending from a point adjacent to said first end of said front edge toward said rear edge at an angle of less than ninety degrees relative to said front edge for a distance less than the length of said front edge, and said second angled crease extending from a point adjacent to said second end of said front edge toward the rear edge at an angle of less than ninety degrees relative to said front edge for a distance less than the length of said front edge, said body being bendable at said first and second angled creases, said first and second angled creases being at the intersection of said front portion of said body with said throat portion of said body.

17. The collapsible refuse funnel of claim 13, wherein said body further includes a front crease formed in said front portion of said body, said front crease extending across said front portion of said body generally parallel to and disposed a short distance inwardly from said front edge, said body being bendable at said front crease such that the portion of said body between said front edge and said front crease may be bent downward at said front crease to form a lip for stiffening said front portion of said body and facilitating the movement of refuse over said front edge of said body.

18. The collapsible refuse funnel of claim 13, wherein said body further includes an elongate stiffening bar extending along said front between said first side edge and said second side edge and interconnected to said body.

19. The collapsible refuse funnel of claim 13, wherein said body further includes a first side crease and a second side crease, said first side crease extending generally parallel to and disposed a short distance inward from said first side edge, and said second side crease extending generally parallel to and disposed a short distance inward from said second side edge, said body being bendable at said first side crease and at said second side crease such that side portions of said body between said first side edge and said first side crease, and between said second side edge and said second side crease may be bent outwardly or inwardly to stiffen and stabilize said side edges.

20. The collapsible refuse funnel of claim 13, wherein said body further includes a first rear crease and a second rear crease, said first rear crease extending generally parallel to said rear edge and disposed a short distance inward from said rear edge on one side of a centerline of said body extending between said front edge and said rear edge equidistant between said side edges, and said second rear crease extending generally parallel to said rear edge and disposed a short distance inward from said rear edge on the other side of said centerline, said body being bendable at said first rear crease and at said second rear crease such that rear portions of said body between said rear edge of said body and said first rear crease, and between said rear edge of said body and said second rear crease can be bent inwardly or outwardly to stiffen and stabilize portions of said rear edge and maintain the generally cylindrical configuration of said refuse passageway.

* * * * *